United States Patent [19]

Richardson

[11] 4,374,078

[45] Feb. 15, 1983

[54] METHOD OF FORMING FLOOR DRAINAGE TROUGH INSTALLATION

[76] Inventor: John K. D. Richardson, 303 Nantucket Blvd., Scarborough, Ontario, Canada M1P 2P2

[21] Appl. No.: 186,626

[22] Filed: Sep. 12, 1980

[51] Int. Cl.[3] ..... E04B 1/16

[52] U.S. Cl. ..... 264/35; 264/250; 52/169.1; 52/309.17; 52/746

[58] Field of Search ..... 52/169.1, 169.7, 309.17, 52/612, 746; 405/43; 264/35, 250

[56] References Cited

U.S. PATENT DOCUMENTS

| | | | |
|---|---|---|---|
| 1,320,256 | 10/1919 | McLeod . | |
| 3,576,069 | 4/1971 | Proctor | 29/527.1 |
| 3,773,874 | 11/1973 | Long | 264/32 |
| 3,898,778 | 8/1975 | Erickson et al. | 52/169 |
| 4,142,337 | 3/1979 | Holcomb | 52/169 |

*Primary Examiner*—James L. Ridgill
*Attorney, Agent, or Firm*—Ridout & Maybee

[57] ABSTRACT

In order in a floor drainage trough installation substantially to prevent gaps between the upper edge portions of the side walls of the floor drainage trough and the body of concrete in which the trough is set, such gaps resulting from shrinkage of the concrete as the body of concrete is cured, strips of woven glass fiber material are provided in the upper edge portions of the side walls of the trough during the molding thereof, with closely spaced loops of the glass fiber material of which the strips are formed being coated with the plastics material of which the trough is formed during the molding of the trough and outwardly projecting under the influence of the inherent resiliency thereof by removing the trough from the mold prior to the plastics material becoming fully set. The loops are securely embedded in the body of concrete, so that during the curing of the body of concrete the shrinkage thereof causes slight splaying apart of the upper edge portions of the side walls of the trough, thereby preventing formation of the above-mentioned gaps.

8 Claims, 2 Drawing Figures

METHOD OF FORMING FLOOR DRAINAGE TROUGH INSTALLATION

This invention, is concerned with a method of forming a floor drainage trough installation of the type comprising a body of cured cementitious material, such as concrete, which constitutes a floor, and a drainage trough which is set into the body of cementitious material and which comprises a bottom wall and upstanding side walls. Such drainage trough installations are commonly provided in, for example, an industrial plant, with the bottom walls of the drainage troughs being downwardly sloped to, for example, a sump or sumps to permit drainage of water used in washing down the floor or to permit drainage of liquid which is used in industrial processes in the plant and which may be spilled on the floor.

It is a disadvantage of such drainage trough installations as hitherto used that in the forming of the installation shrinkage of the body of cementitious material during the curing thereof tends to produce gaps between the body of cementitious material and the side walls of the drainage trough. Such gaps, particularly at the upper edge portions of the side walls of the trough, are of course undesirable since, when the installation is in use, water or other liquid tends to enter these gaps instead of flowing into the drainage trough.

It is accordingly a primary object of the present invention to provide a method of forming a drainage trough installation of the type hereinbefore described but in which the above disadvantage is substantially overcome or obviated by substantially preventing gaps being produced between the body of cementitious material and the upper edge portions of the side walls of the drainage trough during the formation of the installation.

A method according to the present invention comprises the steps of molding plastics material in a mold to form a deformable floor drainage trough comprising a bottom wall and upstanding side walls, with strips of fabric material having closely spaced resilient elements being incorporated in the mold during the molding of the plastics material and being thereby coated with the plastics material, removing the trough from the mold before the plastics material has fully set and allowing said plastics material coated elements under the influence of the resiliency thereof to project outwardly from the upper edge portions of the side walls of the trough, fully setting the plastics material, positioning the trough in a desired location, and pouring a body of cementitious material constituting a floor to set the drainage trough therein with the closely spaced elements of the fabric material being securely embedded in the body of cementitious material. Shrinkage of the body of cementitious material during curing thereof causes deformation of the trough such that the upper edge portions of the side walls of the trough are splayed apart thereby substantially preventing gaps between said upper edge portions of the side walls of the trough and the body of cementitious material.

Figure 1:
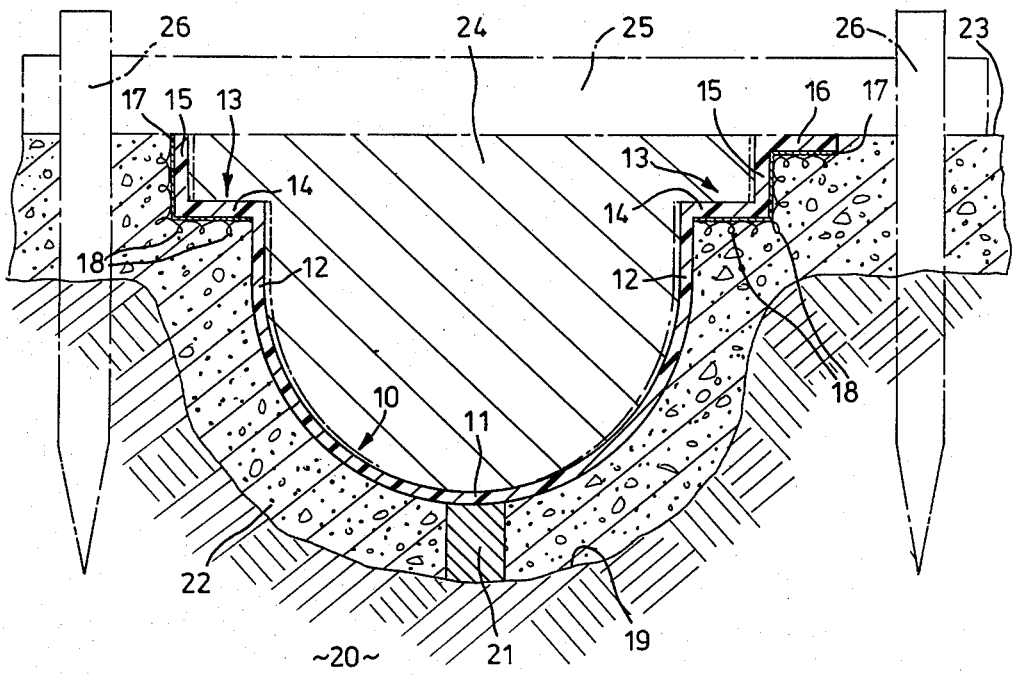
Figure 2:
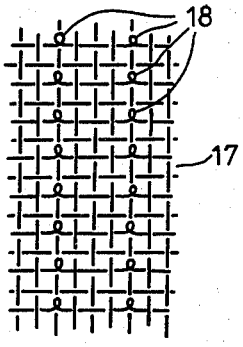

In order that the invention may be more clearly understood and more readily carried into effect the same will now, by way of example, be more fully described with reference to the accompanying drawing in which FIG. 1 is a transverse cross-sectioned view of a floor drainage trough installation formed according to a preferred embodiment of the invention; and FIG. 2 is a diagrammatic plan view of a portion of fabric material, strips of which are shown in FIG. 1.

Referring to the drawing, 10 denotes generally a floor drainage trough which formed of a molded plastics material such as, for example, a polyester plastics material reinforced with one or more layers of glass fiber matting embedded in the plastics material comprising a bottom wall 11, and upstanding side walls 12, the bottom wall 11 and the lower portions of the side walls 12 preferably being of generally curved form in transverse cross-section. This facilitates any cleaning of the drainage trough 10 which may be required since it eliminates any sharp edges between the bottom wall 11 and the side walls 12. The upper edge portions 13 of the side walls 12 preferably present coplanar outwardly directed horizontal shoulders 14 and upstanding wall portions 15. The right-hand portion of FIG. 1 shows a form of the preferred embodiment in which a horizontal flange 16 projects outwardly from the upper end of the wall portion 15, while the left-hand portion of FIG. 1 shows an alternative form of the preferred embodiment in which there is no such horizontal flange 16. When the trough 10 is in use a grating (not shown) is preferably disposed across the trough 10 between the wall portions 15 and in supported contact with the shoulders 14. This grating, the upper face of which is preferably flush with the upper face of the flanges 16 or with the upper edges of the wall portions 15, as the case may be, permitting workmen in the plant in which the trough 10 is installed to walk across the trough 10 without risk of tripping on the trough 10.

The trough 10 also comprises strips 17 of a fabric material which are bonded to and extend along the upper edge portions 13 of the side walls 12, namely, along the shoulders 14, the wall portions 15 and the flanges 16 with reference to the form of the embodiment shown in the right-hand portion of FIG. 1, and along the shoulders 14 and the wall portions 15 with reference to the alternative form of the embodiment shown in the left-hand portion of FIG. 1. These strips 17 of fabric material present loops 18 of the fabric material which project outwardly from the upper edge portions 13 of the side walls 12, the strips 17 of fabric material preferably being constituted by strips of woven fabric material with the loops 18 preferably being presented by weft strands of the woven material, and the fabric material and the loops 18 presented thereby preferably being of glass fiber with the loops 18 being closely spaced apart such as, for example, spaced approximately one inch apart. Such fabric material is commercially available from Les Fils d'August Chomarat & Cie, of 7 rue Roy, 75008, Paris, France. The strips 17 of fabric material are incorporated in the mold during the molding of the trough 10 so that the strips 17 of fabric material are impregnated with the plastics material from which the trough 10 is formed, thereby to provide said bonding of the strips 17 to the trough 10. Furthermore, during the molding of the trough 10 the loops 18 are coated with the plastics material, the trough 10 being removed from the mold before the plastics material has fully set so that under the influence of the natural resiliency of the glass fiber strands constituting the loops 18 these loops 18 then project outwardly as hereinbefore described. When the plastics material is fully set the coating of this plastics material on the loops 18 renders these loops 18 substantially rigid.

In the formation of a floor drainage trough installation incorporating the trough 10 as hereinbefore described with reference to the accompanying drawing the trough 10 is positioned in a desired location in, for example, a trench 19 formed in the ground 20, the trough 10 being supported on, for example, blocks 21 disposed in the bottom of the trench 19. The trough 10 is so positioned that the bottom wall 11 thereof is downwardly sloped to, for example, a sump or the like, this downward sloping preferably being achieved by the depth of the trough 10, i.e. the height of the side walls 12 thereof, being progressively varied along the length of the trough 10. A body 22 of cementitious material, such as concrete, is then poured to set the trough 10 therein, the body 22 constituting a floor 23. The closely spaced loops 18 are securely embedded in the body 22 of cementitious material, thereby securely and substantially continuously to anchor the upper edge portions 13 of the side walls 12 to the body 22 of cementitious material. Thus, during subsequent curing of the body 22 of cementitious material the resultant shrinkage thereof causes deformation of the trough 10 such that the upper edge portions 13 of the side walls 12 are slightly splayed apart, this being permitted by the deformable nature of the plastics material of which the trough 10 is formed. In this manner, the shrinkage of the body 22 of cementitious material during the curing thereof substantially does not result in the formation of any gaps between the upper edge portions 13 of the side walls 12 and the body 22.

During the pouring of the body 22 of cementitious material rigid former means such as transversely disposed plates 24 (shown in FIG. 1 in chain-dotted outline and in crosshatched form) are preferably removably disposed within the trough 10 in order to prevent any inward collapsing of the side walls 12 of the trough 10 caused by the pouring of the body 22. Thus, in FIG. 1 the chain-dotted lines denoting the sides of the plates 23 also denote the initial positions of the inner surfaces of the side walls 12 of the trough 10, the full line illustration of the side walls 12 of the trough 10 in FIG. 1 denoting the position of these side walls 12 after the above-described splaying apart of the upper edge portions 13 of the side walls 12.

During the pouring of the body 22 of cementitious material there may be a tendency for the trough 10 to float upwardly on the cementitious material, and to prevent such upward movement of the trough 10 out of its desired location there may be provided transversely disposed members 25 which are securely attached to stakes 26 driven into the ground 20, the members 25 bearing against the upper edges of the wall portions 15 or against the flanges 16 to restrain the trough 10 against such upward movement.

Steel reinforcing rods (not shown) may be embedded in the body 22 of cementitious material, and as an alternative to the above-described arrangements for preventing movement of the trough 10 during the pouring of this body 22 of cementitious material the loops 18 may, for example, be secured by wire prior to the pouring of the cementitious material to these steel reinforcing rods which are of course fixedly secured in position.

While as hereinbefore described with reference to the accompanying drawing the strips 17 of fabric material are provided only along the upper edge portions 13 of the side walls 12 of the trough 10 such strips 17 of fabric material may, in alternative embodiments (not shown), additionally be similarly provided along the trough 10 at other locations such as, for example, along the bottom wall 11.

Furthermore, it will be understood that instead of the loops 18 of the fabric material there may be provided any form of elements of the fabric material which may be securely embedded in the body 22 of cementitious material such as, for example, hook-shaped elements of the fabric material or other elements having reflexly bent portions.

I claim:

1. A method of forming a floor drainage trough installation comprising the steps of molding plastics material in a mold to form a deformable floor drainage trough comprising a bottom wall and upstanding side walls, with strips of fabric material having closely spaced resilient elements bein incorporated in the mold during the molding of the plastics material and being thereby coated with the plastics material, removing the trough from the mold before the plastics material has fully set and allowing said plastics material coated elements under the influence of the resiliency thereof to project outwardly from the upper edge portions of the side walls of the trough, fully setting the plastics material, positioning the trough in the desired location, and pouring a body of cementitious material constituting a floor to set the drainage trough therein with the closely spaced elements of the fabric material being securely embedded in the body of cementitious material, shrinkage of the body of cementitious material during curing thereof causing deformation of the trough such that the upper edge portions of the side walls of the trough are splayed apart thereby substantially preventing gaps between said upper edge portions of the side walls of the trough and the body of cementitious material.

2. A method according to claim 1, wherein during the pouring of the body of cementitious material rigid former means is removably disposed within the trough to prevent inward collapsing of the side walls of the trough caused by the pouring of the body of cementitious material.

3. A method according to claim 1, wherein the trough is restrained against upward movement to prevent floating of the trough on the body of cementitious material as the body of cementitious material is poured.

4. A method according to claim 1, wherein said closely spaced elements of the fabric material comprise closely spaced loops of the fabric material.

5. A method according to claim 4, wherein said plastics material is a glass fibre reinforced polyester plastics material.

6. A method according to claim 4, wherein the strips of fabric material comprise strips of woven fabric material.

7. A method according to claim 6, wherein the strips of fabric material and said closely spaced loops presented thereby are of glass fibre.

8. A method according to claim 7, wherein said closely spaced loops of the fabric material are spaced approximately 1 inch apart.

* * * * *